US005908000A

United States Patent [19]

Spychalla et al.

[11] Patent Number: 5,908,000

[45] Date of Patent: Jun. 1, 1999

[54] HEAT CURING SYSTEM FOR SILK SCREEN PRINTING PRESS

[75] Inventors: Dennis J. Spychalla, Hartland; Theodore H. Kauth, Milwaukee; Verne R. Holoubek, Hartford, all of Wis.

[73] Assignee: Holoubek, Inc., Waukesha, Wis.

[21] Appl. No.: 08/594,830

[22] Filed: Jan. 31, 1996

[51] Int. Cl.[6] ..... B41F 23/04

[52] U.S. Cl. ..... 101/487; 101/424.1; 101/115

[58] Field of Search ..... 101/487, 488, 101/483, 424.1, 115

[56] References Cited

U.S. PATENT DOCUMENTS

| | | | |
|---|---|---|---|
| 4,501,072 | 2/1985 | Jacobi, Jr. et al. | 34/1 |
| 4,526,101 | 7/1985 | Ericsson | 101/416.1 |
| 4,671,174 | 6/1987 | Tartaglia et al. | 101/115 |
| 4,750,419 | 6/1988 | Meredith | 101/40 |
| 4,798,135 | 1/1989 | Meredith | 101/40 |
| 4,809,608 | 3/1989 | Wolnick et al. | 101/416.1 |
| 5,060,572 | 10/1991 | Waizmann | 101/424 |
| 5,136,938 | 8/1992 | Pellegrina | 101/115 |
| 5,168,811 | 12/1992 | Cox et al. | 101/424.1 |
| 5,178,064 | 1/1993 | Kerber et al. | 101/130 |
| 5,189,960 | 3/1993 | Valentini et al. | 101/487 |
| 5,218,908 | 6/1993 | Whitfield | 101/487 |
| 5,226,362 | 7/1993 | Iaccino et al. | 101/129 |
| 5,249,255 | 9/1993 | Fuqua et al. | 392/412 |
| 5,276,978 | 1/1994 | Hopkins et al. | 34/48 |
| 5,309,838 | 5/1994 | Kurz | 101/480 |
| 5,313,882 | 5/1994 | Karlyn et al. | 101/126 |
| 5,370,046 | 12/1994 | Spiegel et al. | 101/148 |
| 5,423,260 | 6/1995 | Goldberg et al. | 101/424.1 |
| 5,542,764 | 8/1996 | Callewaert | 374/121 |

OTHER PUBLICATIONS

Quartz Flash Cure Unit Operations Manual, Versatiel Products, Inc., Sep. 1993.

Ogden Instruction Manual No. 07, Model ETR–9080, Ogden Manufacturing Co., Jan. 1990.

Omron Type E2K Instruction Manual, Omron Corporation, 1990.

Omron Model H3CA Instruction Manual, Omron Corporation, admitted prior art.

Raytek Thermalert CI Compact Infrared Sensor Operator's Guide, Raytek, Inc., 1994.

*Primary Examiner*—Edgar S. Burr

*Assistant Examiner*—Anthony H. Nguyen

*Attorney, Agent, or Firm*—Andrus, Sceales, Starke & Sawall

[57] ABSTRACT

A multi-colored silk screen printing machine has an improved electric resistance heating station to cure silk screen printed ink on a substrate such as a textile. A control system has a proximity switch that detects the presence of a pallet within the heat curing station and starts supplying electrical power to a bank of electric resistance heaters automatically only when a pallet is present. An infrared temperature sensor is used to measure the ink temperature when the bank of electric resistance heaters is heating the printed ink on the textile. The infrared sensor provides a signal to a control system that interrupts power to the bank of electric resistance heaters when the signal exceeds a preselected maximum ink temperature value. A timer can also be used to override the infrared temperature sensor. A sheltered passageway and a low level air flow therethrough protect the face or lens of the infrared sensor from gases, smoke or other types of contamination. The heat curing unit also uses a board made of a heat retaining material to support the bank of electric resistance heaters, thereby promoting quicker, more uniform heating of subsequent units entering the heat curing unit.

14 Claims, 5 Drawing Sheets

FIG. 3
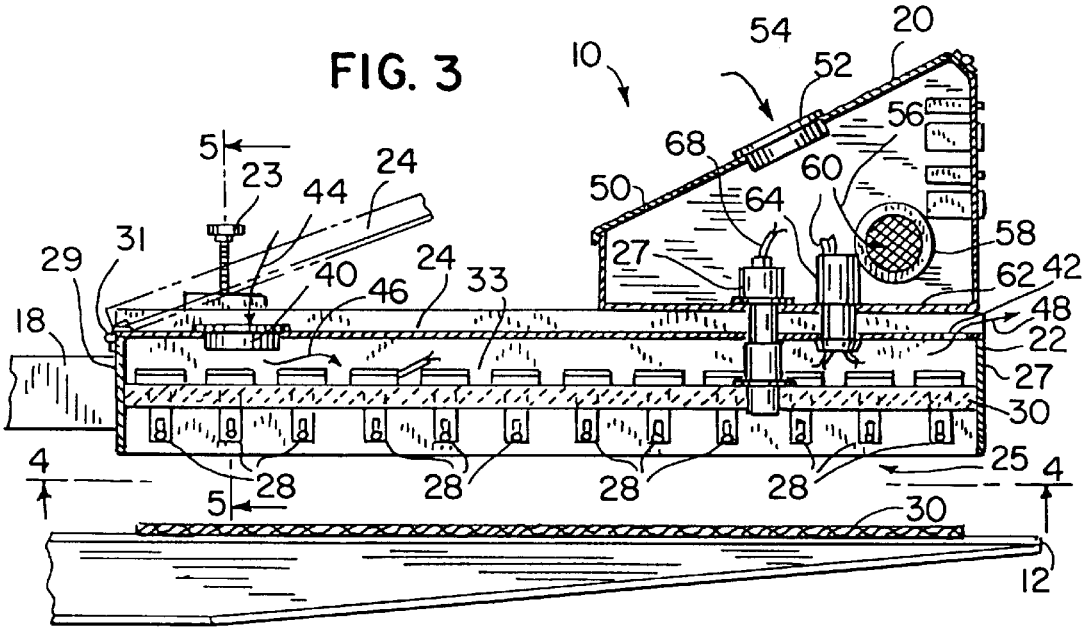
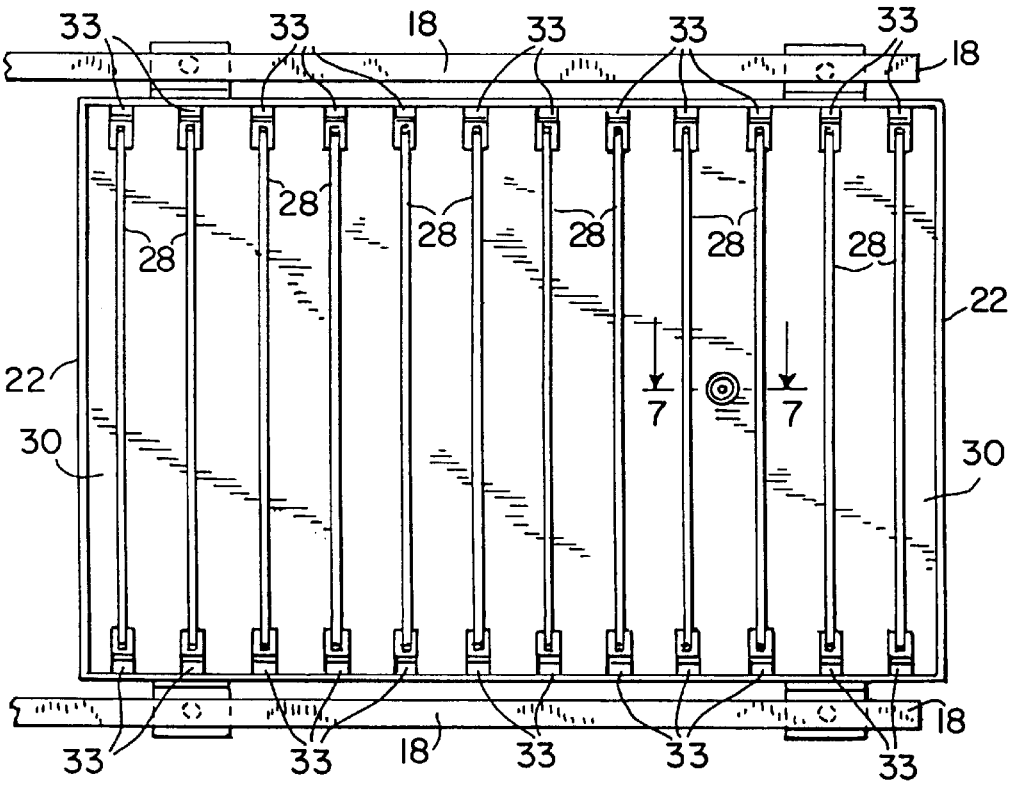
FIG. 4

HEAT CURING SYSTEM FOR SILK SCREEN PRINTING PRESS

FIELD OF THE INVENTION

The invention relates to multi-colored silk screen printing machines. Specifically, the invention relates to an improved electrical resistance heating station to cure silk screen printed ink on a substrate material such as a textile.

BACKGROUND OF THE INVENTION

Multi-colored silk screen printing presses are used to print multi-colored images on substrate materials such as a T-shirts, sweatshirts, posters, etc. The substrate material is mounted on one of several pallets which typically extend radially from an indexed turret. The turret is rotated to move the pallets among a plurality of print units located peripherally around the turret. Each of the print units prints a different color, to produce a multicolored image on the substrate material.

Silk screen printing machines have one or more heat curing stations intermingled among the several print stations. The heat curing stations use electric resistance heating elements, such as a bank of quartz flash lamps, to quickly heat previously printed ink and sufficiently cure the ink before printing another color at a subsequent print station. It is not always necessary to cure a previous layer of ink before printing a subsequent layer. This is true when the previous layer is a thin layer of ink. On the other hand, it is almost always necessary to cure a first base layer of ink printed on the substrate material (e.g. a base layer printed on a T-shirt). Also, it may be desirable to cure after applying a subsequent heavy layer of ink, or even after applying two or more thin layers of ink consecutively.

A bank of quartz flash heater bulbs in a cure unit is capable of producing temperatures up to about 1200° F. To cure the ink, the bank of flash lamps is placed in close proximity (e.g. 2–3 inches) above the image on the printed material, and the bank of quartz flash lamps is powered to supply extreme heat and raise the temperature of the ink to a curing temperature, or slightly above. The curing temperatures for different types of inks can vary, but generally range from 200° F.–350° F. Controls for prior quartz flash cure units typically turn the bank of flash lamps off after a preselected time period that is set by an operator of the press by adjusting a potentiometer.

If the quartz flash lamps are on too long, the lamps can scorch the ink or the underlying substrate material, or can otherwise damage the final product. Press operators often adjust the potentiometer that controls the activation time for the quartz flash lamps on the basis of trial and error. This can present a problem because heat transfer characteristics on the system vary with respect to many factors, including the characteristics of the underlying substrate material, the type of ink, as well as the operating conditions surrounding the curing unit. For instance, it may take the curing unit 5–7 seconds to raise the ink temperature from room temperature to a cure temperature at a first curing station, but only 2–3 seconds at a subsequent curing station after the item has been heated. In addition, each particular curing station typically heats faster as the machine continues in operation because residual heat does not dissipate completely. Since the press operators do not know the actual temperature of the ink, it is difficult for the operators to accurately regulate the activation time for the quartz flash units.

There have been some efforts in the industry to promote dissipation of the residual heat by the use of fans and the like. However, these methods tend to increase the required curing time and can even slow production of the overall printing process.

SUMMARY OF THE INVENTION

The invention is directed primarily to an automatically indexing silk screen printing machine having a series of pallets that are moved sequentially along a plurality of print processing stations which include a plurality of silk screen printing stations and at least one heat curing station. The heat curing station has a bank of electrical resistance heaters for heat curing ink printed on a substrate.

A primary object of the invention is to provide a heat curing system that does not scorch ink or the underlying substrate material, or otherwise damage the final printed product. The invention accomplishes this objective through the use of a control system having an infrared sensor that senses the temperature of the ink printed on the substrate and a temperature controller that receives a signal from the infrared sensor and interrupts power to the bank of electric resistance heaters when the value of the signal from the infrared sensor exceeds a preselected maximum ink temperature value. The preselected maximum temperature value should be set at the ink curing temperature or slightly below because of possible overshoot.

In the preferred control system, a proximity switch detects when a pallet is located within the heat curing station, and triggers the control system to automatically supply electrical power to the electric resistance heaters only when a pallet is located in the heat curing station. This has the advantage of conserving electricity. The preferred control system also provides a manual override switch that allows an operator to supply power to the electric resistance heaters even when the proximity switch does not sense the presence of a pallet in the heat curing station.

The preferred control system includes a timer that starts when power is supplied to the bank of electric resistance heaters, and provides a signal to the control system to interrupt power to the electric resistance heaters when the heaters have received electrical power for a period of time greater than or equal to a preselected maximum time period. With this feature, the bank of electric resistance heaters will be turned off after the preselected maximum time period even if the infrared temperature sensor fails or some other aspect of the system fails.

The preferred control system includes the use of electromechanical control relays with mechanical contacts as well as microprocessor logic controls. In the preferred embodiment of the invention, a special time-delayed, control relay switch is provided to allow electric power to be supplied to the electric resistance heaters in case the proximity switch senses the presence of a pallet in the heat curing station and the control system has not had enough time to reset the necessary electrical contacts to allow the system to power the bank of electric resistance heaters.

Another object of the invention is to provide an environment promoting the reliability of the infrared temperature sensor. The invention accomplishes this object by locating the infrared sensor within a sheltered passageway having a line of sight directed to the location where the printed ink on the substrate will be located when a pallet is located in the heat curing station. Furthermore, a low level of air flow is provided in front of the lens or face of the sensor, and flows downward through the passageway to shelter the lens from gases, smoke or other contaminants that might otherwise interfere with the reliability of the infrared sensor. The preferred way of accomplishing the low level of air flow is to mount a passageway tube structure so that it extends downward from a control box for the system, and provide a cooling fan to blow air into the control box to create a positive pressure within the control box. The positive pressure within the control box is preferably used to provide the low level air flow in front of the lens of the sensor by mounting the sensor in the top part of the passageway tube structure and providing openings from the control box through the top part of the passageway tube structure that are directed in front of the lens of the infrared sensor.

Another object of the invention is to retain residual heat from curing ink on previous printed units. The invention accomplishes this object by mounting the bank of electric resistance heaters to a heat retaining support board, preferably made out of a material such as that sold under the trade name Marinite. In this manner, the area directly under the electric resistance heaters heats up faster and more uniformly as subsequent pallets enter the heat curing station. In this aspect of the invention, it is preferred that the heat retaining board span essentially horizontally across the entire housing for the bank of electric resistance heaters. The electric resistance heaters are mounted to and underneath the heat retaining support board so that the electric resistance heaters are exposed to the printed substrate on the pallet. It is preferred that the top of the housing have a hood, thus defining an enclosed chamber or space between the hood and the heat retaining support board. The control box is preferably mounted to the hood, and it is preferred that a cooling fan blow cooling air into the chamber between the hood and the heat retaining support board to cool the space above the heat retaining support board and protect the electrical and electronic control elements of the system.

The hood on the housing preferably has a hinge located towards the center of the silk screen press, and therefore provides easy access to service the bank of electric resistance heaters.

In the preferred embodiment, the bank of electric resistance heaters consist of 12 quartz flash lamp bulbs separated into two separate zones. An operator of the system can select to run either one heater zone, or both heater zones.

Other objects and features of the invention may be apparent to those skilled in the art upon reviewing the drawings and the following description thereof.

BRIEF DESCRIPTION OF THE DRAWINGS

FIG. 3 is a sectional view showing the components of the heat curing station shown in FIG. 2.

FIG. 4 is a view taken along lines 4—4 in FIG. 3.

DETAILED DESCRIPTION OF THE DRAWINGS

Figure 1:
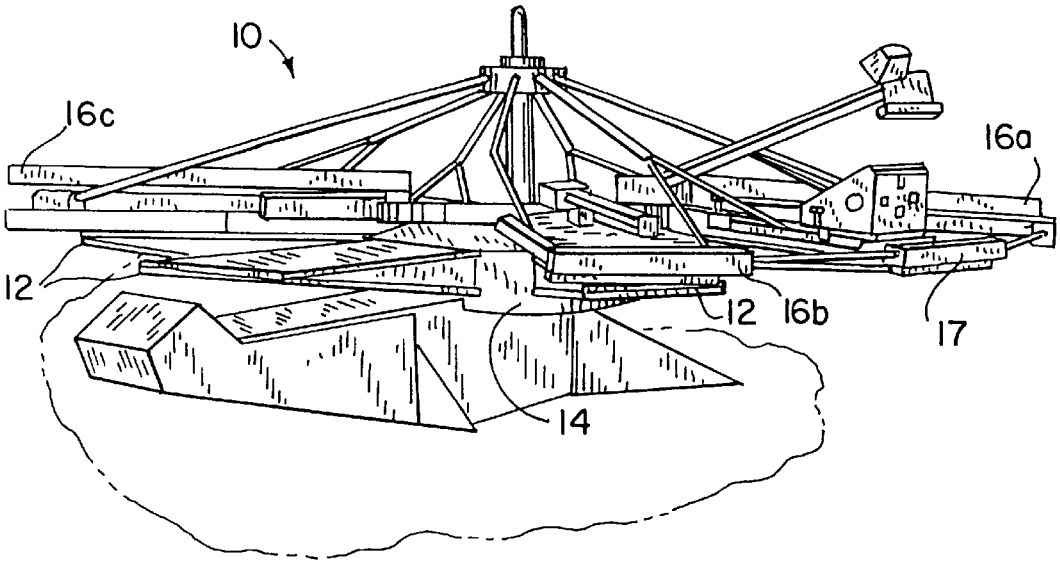
FIG. 1 is a perspective view of an automatically indexing silk screen printing machine having an improved heat curing station in accordance with the invention.

FIG. 1 illustrates an automatically indexing silk screen printing machine 10 having a series of pallets 12 extending radially from an indexed turret 14. The turret 14 rotates to move the pallets 12 among a plurality of print stations 16*a* through 16*c* which are successively located peripherally around the turret 14. The print stations 16*a* through 16*c* shown in FIG. 1 are silk screen printing stations. A heat curing station 17 is located between print station 16*a* and print station 16*b*. The invention is directed to an improved heat curing station 17.

The print stations 16*a* through 16*c* and the heat curing station 17 are stationary with respect to the turret 14. The pallets 12 move among the plurality of print stations 16*a* through 16*c* and the heat curing station 17 when the turret 14 rotates.

Figure 2:
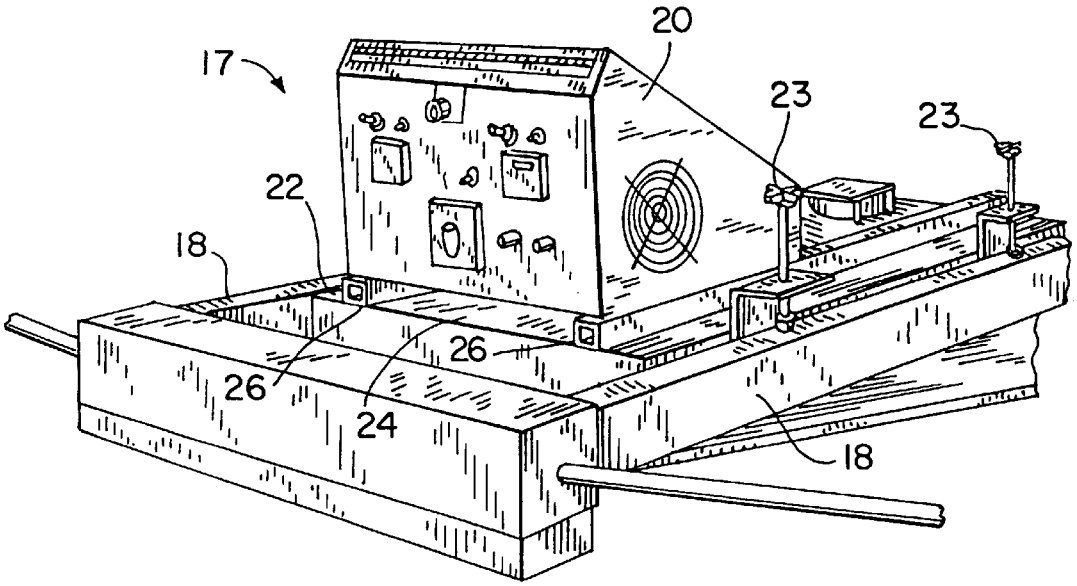
FIG. 2 is a perspective view of a heat curing station in accordance with the invention.

Referring to FIGS. 2 and 3, the heat curing station 17 is mounted to a stationary frame 18. The heat curing station 17 has a control box 20 mounted on top of a flash unit housing 22. The flash unit housing 22 is mounted to the frame 18 using slidable brackets 23, which allows both the height and the radial position of the flash unit housing 22 to be adjusted with respect to the stationary frame 18. A bank of electric resistance heaters, preferably a bank of quartz flash heater bulbs 28, is located within the flash unit housing 22 so that the heaters 28 are exposed to a printed substrate material 30, such as a textile, on pallet 12. When the heat curing station 17 is in operation, the electric resistance heaters 28 are preferably located two to four inches above the substrate 30 on the pallet 12. A control system using an infrared temperature sensor 27 to measure the temperature of ink on the printed substrate 30 is contained in the control box 20.

Figure 5:
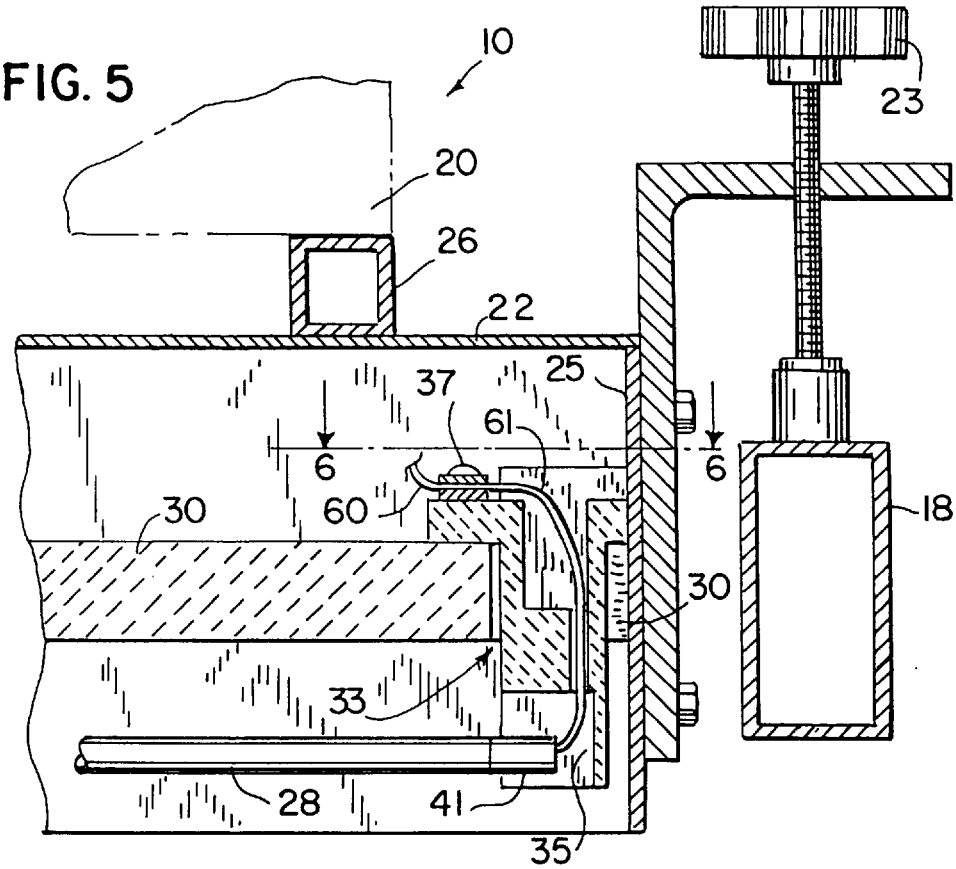
FIG. 5 is a partial sectional view taken along lines 5—5 in FIG. 3.

The flash unit housing 22 is generally rectangular and is preferably made of ⅛ inch thick aluminum. The flash unit housing 22 has a top hood 24, and an open bottom 25. The control box 20 is mounted to the hood 24 of the flash unit housing 22. As is shown in FIGS. 2, 3 and 5, the preferred way of mounting the control box 20 to the hood 24 of the housing 22 involves the use of one inch rectangular aluminum tubular supports 26. The tubular supports 26 are preferably mounted on the hood 24 of the housing 22, and the control box 20 is preferably mounted atop the tubular supports 26.

Referring now to FIGS. 3 and 4, a heater support board 30 is mounted horizontally within the flash unit housing 22. The heater support board 30 is preferably made of one inch thick heat retaining board such as board sold under the trade name Marinite. The heater support board 30 substantially spans the entire horizontal area within the flash unit housing 22. The heaters 28 are mounted to the bottom side of the support board 30 so that the heaters 28 are exposed to the substrate 30 on the pallet 12 through the open bottom 26 of the housing 22.

The hood 24 of the housing 22 is connected to the top of a rear vertical wall 29 of the housing 22 with one or more hinges 31. The hood 24 otherwise sits on top of the walls of the housing 22 without connection. In this manner, the hood 24 of the housing 22 can be opened to allow access into a top chamber or space 33 of the housing 22 located above the heater support board 30. This in turn allows easy access to replace individual flash lamp bulbs 28, or otherwise service the heat curing unit.

Figure 6:
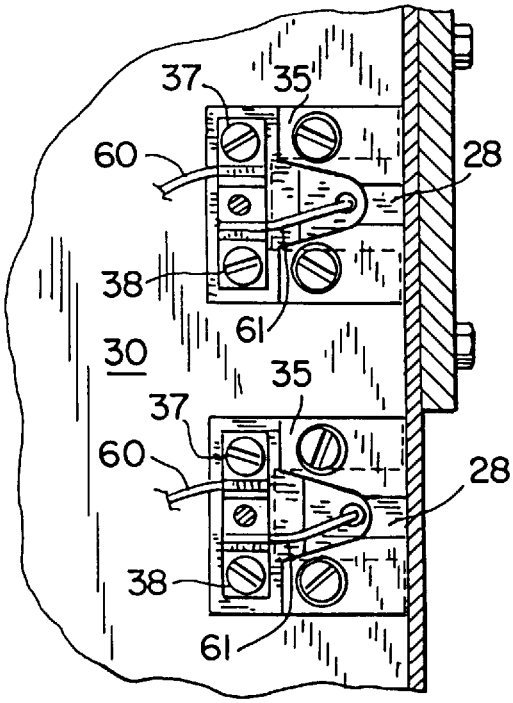
FIG. 6 is a view detailing electrical connections taken along lines 6—6 in FIG. 5.

FIGS. 5 and 6 show in detail how various elements of the heat curing unit 10 are mounted to the flash unit housing 22. As described above, the control box 20 is mounted on tubular supports 26 which are mounted on the hood 24 of the housing 22. The side walls 25 of the housing 22 are substantially vertical and perpendicular to the hood 24. The adjustable mounting brackets 23 are attached to the sidewall 25 of the housing 22. The electric resistance heaters 28 are mounted underneath the heat retaining support board 30 using a plurality of thermally-insulated, electric heater support brackets 35 mounted through a plurality of peripheral openings 33, FIG. 4, in the support board 30. Each of the heater brackets 35 preferably includes a porcelain socket 41 for holding an end of the quartz bulb 28, electrical terminals 37, 38, and an internal wire 61 connecting terminal 37 to the socket 41 for the bulb 28. Terminal 38 is not used in this embodiment of the invention.

Figure 9:
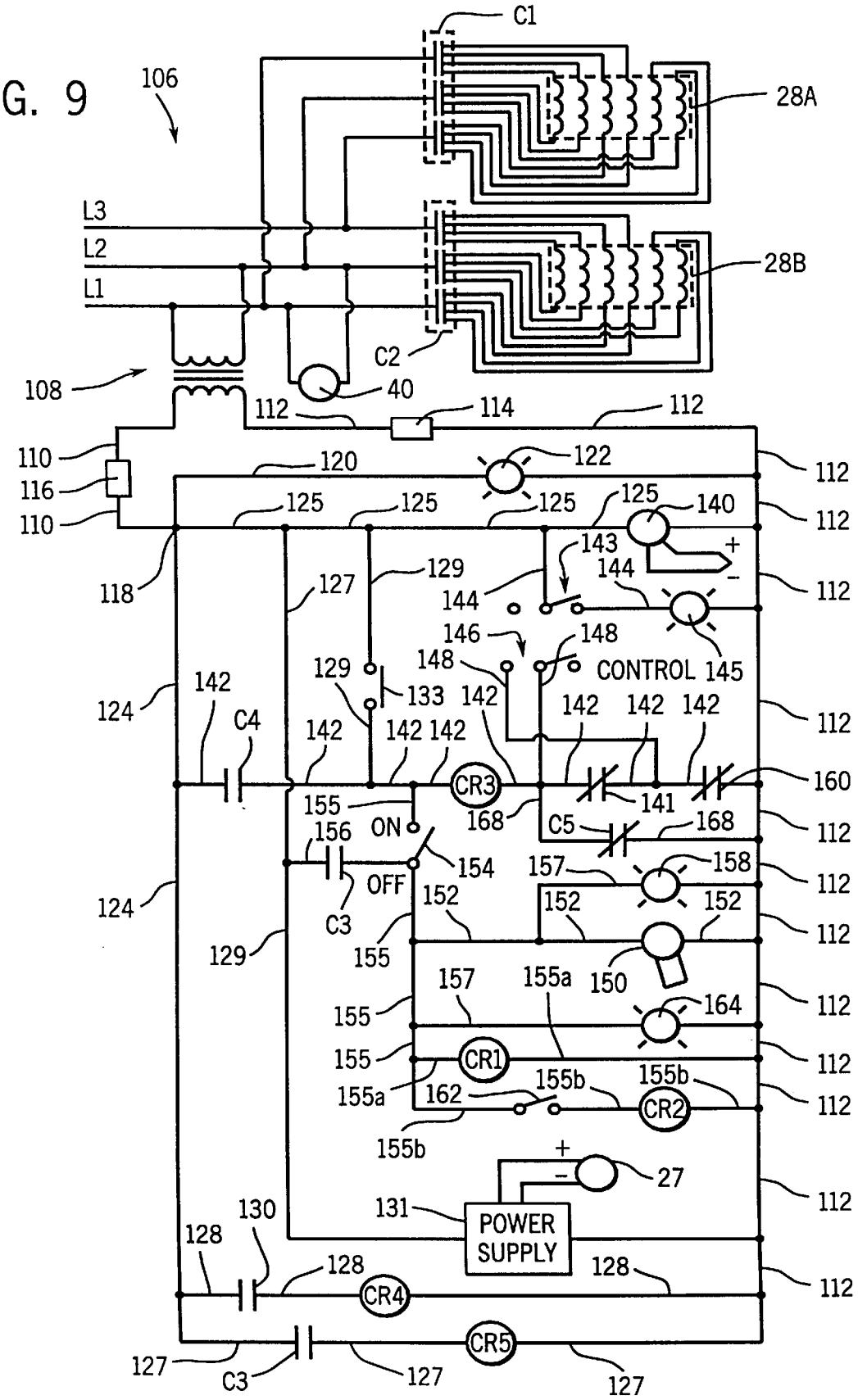
FIG. 9 is a control circuit diagram illustrating the preferred way of controlling the operation of the heat curing station shown in the above-described figures.

The heat curing station 10 is preferably powered with 220 volt, three-phase electrical AC power. It is preferred that the 12 quartz bulbs be split into a first zone 28A and a second zone 28B, FIG. 9. The quartz bulbs in zones 28A and in zone 28B should be wired to maintain a balanced circuit even if only one zone 28A or 28B is in use. This can be done by wiring two bulbs in each zone 28A and 28B to each of the three pairs of power supply lines L1, L2, L3, as shown in FIG. 9.

Referring now to FIG. 3, electrical power is supplied to the electric resistance heaters 28 from an electrical adaptor (not shown) in control box 20. From the electrical adaptor, electric power lines 60 are passed through the bottom 62 of the control box 20, and through the hood 24 of the flash unit housing 22 where they are connected to the electric resistance heaters 28. The electric power lines 60 should be made of high temperature wire, preferably fiberglass coated wire. A plastic wire conduit 64 shields the passage of the power lines 60 from the control box 20 to the flash unit housing 22.

Referring still to FIG. 3, a fan 40 is located in the hood 24 of the flash unit housing 22 at the rear end of the housing 22 near the hinge 31. At least one air outlet hole 42 is located through the hood 24 at the other end of the housing 22. Preferably, three air outlet holes 42 are located in the hood 24 at the other end of the housing 22. The fan 40 draws ambient air into the chamber 33 between the hood 24 and the support board 30 as indicated by arrows 44 and 46. The fan 40 continues to draw air into the chamber 33, and eventually the air blows out of the chamber 33 through the air outlet holes 42 as depicted by arrows 46 and 48. Drawing cooling air through the chamber 33 keeps the hood 24, and especially the components within the control box 20, from becoming excessively hot.

The control box 20 has a removable lid 50. A cooling fan 52 is located in the removable lid 50, and blows cooling air into the interior of the control box 20 as depicted by arrows 54 and 56. A vent 58 is provided to allow the cooling air to escape from the control box 20.

Figure 8:
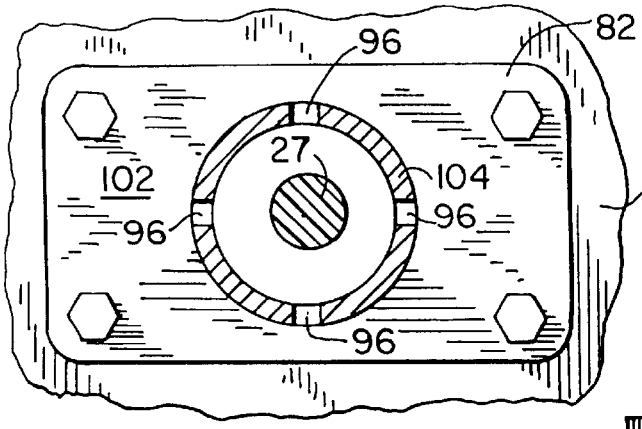
FIG. 8 is a sectional view taken along lines 8—8 in FIG. 7.
Figure 7:
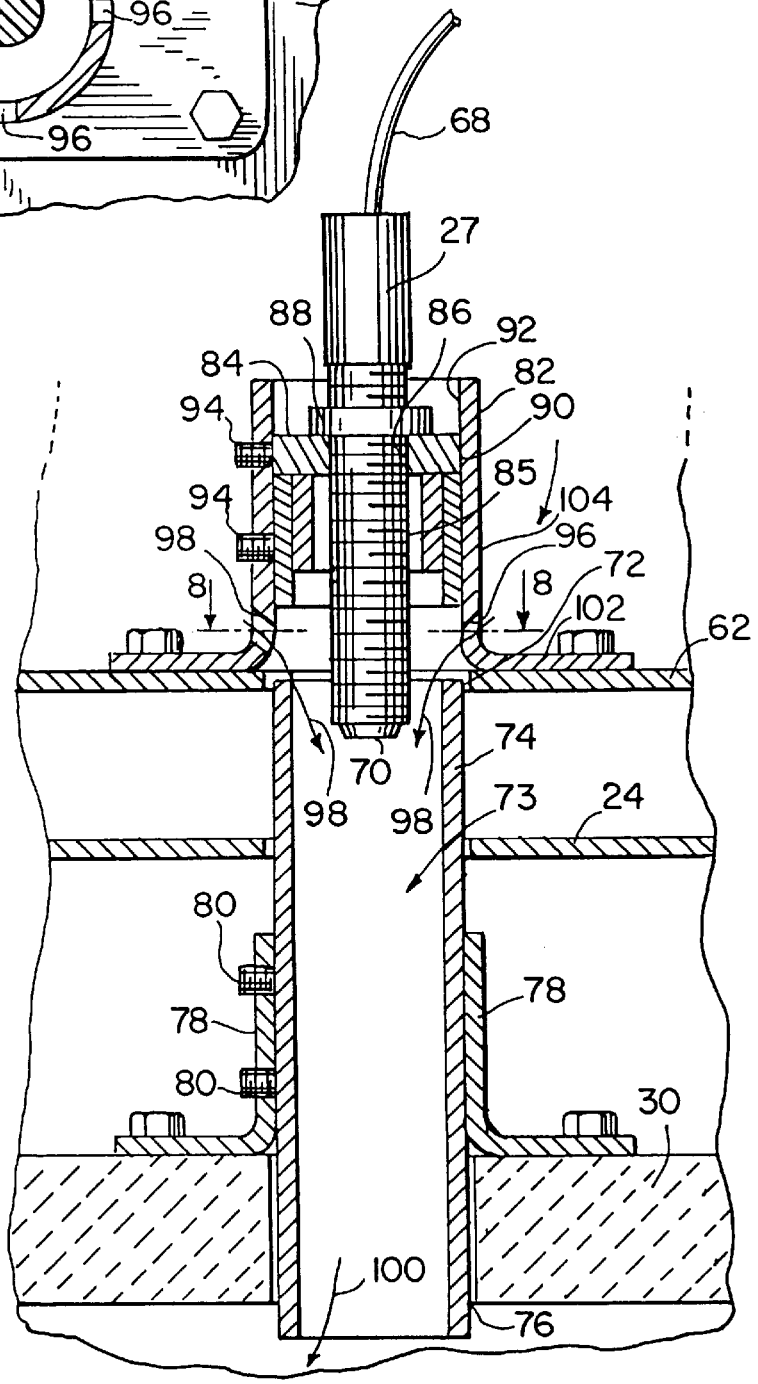
FIG. 7 is a detailed view showing a way of mounting an infrared sensor in the heat curing station shown in FIG. 3.

The heat curing station 10 has an infrared sensor 27 that senses the temperature of ink printed on the substrate 30, and generates an ink temperature signal in response thereto. The ink temperature signal is transmitted to the control system through line 68. The infrared sensor 27 is preferably a compact infrared sensor powered by a 12 or 24 volt DC power supply. FIGS. 7 and 8 illustrate the preferred method of mounting the infrared sensor 27 within the heat curing unit 10. The infrared sensor 27 is mounted so that a face or lens 70 of the infrared sensor 27 extends through a hole 72 in the floor 62 of the control box 20. The lower part of the infrared sensor 27 including the face 70 extends into a sheltered passageway 73. The sheltered passageway 73 is preferably in the form of a round tube 74 that extends from the hole 72 in the bottom 62 of the control box 20, through the hood 24 of the flash unit housing 22, and through a hole 76 in the heater support board 30. The face 70 of the infrared sensor 66 is thus exposed to the substrate 30 on the pallet 12 via a line of sight through the sheltered passageway 73. The sheltered passageway tube 74 is mounted in place using a tubular flange bracket 78 mounted to the top of the heater support board 30 concentric with the hole 76 through the support board 30. The sheltered passageway tube 74 is secured within the tubular flange bracket 78 preferably with set screws 80. When the hood 24 of the flash unit housing 22 is opened, the sheltered passageway tube 74 remains in place secured to the heater support board 30 via bracket 78.

The infrared sensor 27 is secured to the bottom 62 of the control box 20 using a sensor flange bracket 82 and a fitting 84 located within the sensor flange bracket 82. The sensor 27 preferably has a threaded portion 85 that can be secured in a threaded opening 86 in the bracket 84. A securing nut 88 is preferably threaded onto the threaded portion 85 of the sensor 27, and is well suited for adjusting the height of the sensor face 70. An external wall 90 of the fitting 84 is preferably in the shape of a circular cylinder so that it fits snugly within the inner cylindrical wall 92 of the sensor flange bracket 82. The fitting 84 is secured within the sensor flange bracket 82 with set screws 94.

The fan 52 in the lid 50 of the control box 20 creates a positive pressure within the control box 20, even through most of the cooling air escapes through vent 58 as depicted by arrow 56, FIG. 3. The sensor flange bracket 82 preferably includes four openings 96 to provide a low level of air flow as depicted by arrows 98, FIG. 7, in front of the face 70 of the infrared sensor 27. The low level air flow flows through the sheltered passageway 73 in tube 74, and exits at the bottom of the tube 74 as depicted by arrow 100. The low level of air flow in front of the face 70 of the infrared sensor 27 shelters the face 70 from contaminants that might find their way into the sheltered passageway 73 in the tube 74. The low level of air flow through the tube 74 helps keep contaminants from propagating upwards towards the face 70 of sensor 27. The low level of air flow through the passageway 73 in the tube 74 also helps keep the temperature at the face 70 of the sensor 27 relatively low, which is important for the integrity of the sensor 27.

The sensor flange bracket 82 includes a lower attachment portion 102 and an upright, cylindrical sensor support portion 104 perpendicular to the attachment portion 102. The small air flow openings 96 are located circumferentially at the lowermost part of the sensor securing portion 104 by the bend between the securing portion 104 and the attachment portion 102.

The preferred control 106 system for regulating the operation of the electric resistance heaters 28 is illustrated schematically in FIG. 9. The preferred control system 106 illustrated in FIG. 9 uses electro-mechanical components such as electro-mechanical contact switches actuated by control relays, however, other types of control systems 106 could be implemented to carry out the invention.

Electrical power in the form of three-phase, 220 volt electricity inputs the system 106 on electrical power lines L1, L2 and L3. The electric resistance heaters 28 are separated into a first zone 28A, and a second zone 28B, each preferably consisting of six quartz flash lamps.

The first zone heaters 28A are powered by lines L1, L2 and L3 when a three-pole contact labeled C1 is closed. The second zone heaters 28B are powered by lines L1, L2 and L3 when a three-pole contact C2 is closed. Each zone of heaters 28A and 28B has six electric resistance heaters. Note that the wiring configuration for the heaters in zones 28A and 28B are balanced, and remain balanced when only one of the heaters 28A or 28B is turned on. Cooling fan 40 which is mounted through the hood 24 of the flash unit housing 22 receives power through lines L1 and L2.

A transformer 108 receives input power through lines L1 and L2, and transmits power to the control system 106 through lines 110 and 112. The transformer is preferably 100 KVA transformer outputting single-phase, 115 volt AC electrical power which is used as a control signal for the control system 106, and to power various components in the control system 106. A fuse 114 is located in line 112, and another fuse 116, is located in line 110. The fuses 114 and 116 are preferably 2 amp fuses. The current from transformer 108 is typically about 1 amp.

Power in line 110 is transmitted through fuse 116 to junction 118. Power is supplied from junction 118 through line 120 to an indicator light 122 which illuminates to indicate that power is being supplied to the heat curing unit 10.

Power is supplied from junction 118 through lines 124 and 128 to a proximity switch 130. The proximity switch detects when a pallet 12 is located at the heat curing station 10. The proximity switch 130 can be any suitable proximity switch such as a laser-type proximity switch. The proximity switch 130 is preferably a static capacity type proximity switch having approximately a 3 inch range. The proximity switch 130 is mounted to the heater housing 22. A suitable proximity switch 130 for this application is manufactured by Omron Corporation, type E2K. The purpose of the proximity switch 130 is to prevent electrical power from automatically being provided to the electric resistance heaters 28A and 28B when a pallet 12 is not located at the heat curing station 10. The proximity switch 130 closes when the switch 130 detects a pallet 12 in the heat curing station 10. When a pallet is located in the heat curing station 10 and the proximity switch 130 is closed, control relay CR4 receives power and causes contact C4 in line 142 to close. When the contact C4 is closed, power is supplied from junction 118 through lines 124, and 142 to control relay CR3. When control relay CR3 receives power, it closes contact C3 in line 156 to provide power in line 155. The control relay CR3 also closes contact C3 in line 127.

When electrical power is supplied through lines 155 and 155*a* to control relay CR1, the three-pole contact C1 in lines L1, L2 and L3 is closed to provide electrical power to the first zone of the electric resistance heaters 28A. When electrical power is provided through lines 155 and 155*b* to control relay CR2, the three-pole contact C2 in lines L1, L2 and L3 is closed, thus providing electrical power to the second zone of electric resistance heaters 28B. Switch 162 in line 155*b* is preferably a manually operated switch that can be open when it is desirable to use only the first zone of the electric heaters 28A. When power is provided in lines 155 and 155*a* to relay CR1, power is also provided through lines 155 and 157 to an indicator light 164 which illuminates to indicate that electric power is being supplied to control relay CR1, and in turn indicates that the three-pole contact C1 should be closed to provide power to the first zone of electric resistance heaters 28A; and additionally to indicate that, unless switch 162 is open, power is being provided to control relay CR2 and the three-pole contact C2 should be closed, thus providing power to the second zone of electric resistance heaters 28B.

Power from junction 118 is supplied through lines 125, 127 and 129 to a power supply 131 for the infrared sensor 27. The power supply 131 preferably supplies 24 volt DC power to the infrared sensor 27.

Power is also supplied from junction 118 through lines 125 to temperature controller 140. The temperature controller is preferably a microprocessor-based autotune PID controller such as model ETR-9080 made by Ogden Manufacturing Company. The temperature controller 140 receives an ink temperature signal from the infrared sensor 27.

A preselected maximum ink temperature value can be set in the temperature controller 140. It is preferred that the preselected maximum ink temperature value be set at the cure temperature of the ink, or slightly above. When the ink temperature signal from the infrared sensor 27 exceeds the preselected maximum ink temperature value set in the temperature controller 140, the temperature controller 140 will transmit a signal to open a normally closed temperature relay 141 located in line 142. An ON/OFF switch 143 for the temperature controller 140 is placed electrically in parallel with the temperature controller 140 in line 144. An indicator light 145 receives power in line 144 when the temperature controller ON/OFF switch 143 is in the ON position.

In addition to temperature controller ON/OFF switch 143 which provides power to the indicator light 145 when the temperature controller 140 is in use, another ON/OFF switch 146 is provided so that the normally-closed temperature relay 141 in line 142 can be bypassed electrically through line 148 when the temperature controller 140 is not in use.

The control system 106 includes a timer 150 in line 152. The preferred timer is a solid state timer, and a suitable timer is manufactured by Omron Corporation, model H3CA. The purpose of the timer 150 is to interrupt power to the electric resistance heaters 28A and/or 28B if the electric resistance heaters have received electrical power for a period of time greater than or equal to a preset maximum time period. A timer ON/OFF switch 154 allows power to be transmitted to the timer through lines 155 and 152 when the switch 154 is closed, even if contact C3 in line 156 is open. This allows the timer 150 to be used to control the interruption of power even if the temperature controller 140 is turned off. If the contact C3 in line 156 is closed or if switch 154 is closed, power is transmitted through lines 155 and 152 to the timer 150. Power is also transmitted through line 157 to power an indicator light 158 which is illuminated to show that the timer 150 is on. When power has been transmitted to the timer 150 greater than or equal to the preset maximum time period, the timer 150 opens a normally-closed, timer relay switch 160 located in line 142 downstream of the temperature control relay switch 141. In this manner, the electrical path through line 142 will be broken if either the ink temperature signal from the infrared sensor 27 exceeds the preselected maximum ink temperature value set in the temperature controller 140, or the electric resistance heaters 28A and 28B have received electrical power for a period of time greater than or equal to the preselected maximum time period set in the timer 150. When the electrical path in line 142 is interrupted, control relay CR3 in line 142 falls out and opens contact C3 in line 156 which interrupts power to line 155, assuming that switch 154 is open. Interrupting power to line 155 causes control relay CR2 in line 155 and control relay CR1 in line 156 to fall out. When control relay CR1 in line 156 falls out, it opens the three-pole contact C1 in power supply lines L1, L2 and L3, and therefore interrupts power to the first zone of electric resistance heaters 28A. When power is interrupted to control relay CR2 in line 155, the three-pole contact C2 opens, thus interrupting power to the second zone of electric resistance heaters 28B.

When the control relay CR3 in line 142 falls out it not only opens contact C3 in line 156, but also opens contact C3 in line 127. When contact C3 in line 127 opens, power is interrupted to control relay CR5 in line 127 thus causing a normally-closed, time-delayed relay contact C5 in line 168 to close. The time-delayed relay contact C5 is connected electrically in parallel with the temperature control relay 141. The purpose of control relay CR5 and time-delayed contact C5 is to allow electrical power to be supplied to the electric resistance heaters 28A and 28B after the proximity switch 130 senses the presence of a pallet 12 in the heat curing station 10, and before the temperature controller 140 has time to reset. In particular, time-delayed contact C5 in line 168 will remain closed for a short period of time (e.g. about 1–2.5 seconds) when the proximity switch 130 senses a pallet 12 in the heat curing station. The proximity switch 130 also closes contact C4 in line 142. Since contact C5 in line 168 is closed, the electrical path for relay CR3 in line 142 across the transformer 108 can be completed. This allows control relay CR3 to actuate contact C3 in line 156 to provide power to control relay CR1 and CR2 that start power electric resistance heaters 28A and 28B. Control relay CR3 also actuates contact C3 in line 127. Once contact C3 in line 127 is closed, power is transmitted to control relay CR5 and contact C5 in line 168 opens.

A manual override switch 133 is provided in line 129. The override switch 133 is preferably normally-open, and can be manually actuated to provide momentary power to the electric resistance heaters 28A and 28B even when the proximity switch 130 does not sense the presence of a pallet 12 in the heat curing unit to close contact C4 in line 142. When override switch 133 is closed, power is transmitted from lines 110 and 125 through line 129 to line 142, and eventually to control relay CR3 in line 142. The override switch 133 can then be used to actuate contact C3 in line 156 to provide power through line 155 to control relays CR1 and CR2 and eventually close triple-pole contacts C1 and C2 to provide power to the electric resistance heaters 28A and 28B.

Various modifications, alternatives or equivalents may be apparent to those skilled in the art. Such modifications, alternatives or equivalents should be considered to fall within the scope of the following claims.

I claim:

1. A method for curing ink printed on a material comprising the steps of:

placing an electrical resistance heater at a distance between two to four inches to the ink printed on the material;

supplying power to the electrical resistance heater to heat the ink for curing;

sensing the temperature of the ink with an infrared sensor as the heater is heating the ink and generating an ink temperature signal in response thereto;

comparing the value of the ink temperature signal to a preselected maximum temperature value and interrupting power to the electrical resistance heater when the value of the ink temperature signal is greater than or equal to the preselected maximum temperature value;

providing a sheltered passageway extending away from a face of the infrared sensor around a line of sight for the infrared sensor; and blowing a low level air flow through the sheltered passageway generally in a direction away from the infrared sensor and in front of the face of the infrared sensor to shelter the face from contaminants.

2. A method for curing ink as recited in claim 1 further comprising the steps of:

timing the period of time that power is supplied to the electrical resistance heater; and interrupting power to the heater when the measured period of time exceeds a preselected maximum time period, even if the value of the ink temperature signal is less than the preselected maximum temperature value.

3. In an automatically indexing silk screen printing machine having a plurality of ink layers printed successively on a plurality of textile items, a method of the printing plurality of ink layers and curing ink printed on the textile items comprising the steps of:

a) screen printing an underprinted base layer of ink on one of the textile items at a first print processing station;

b) moving the textile item to a second print processing station and placing an electrical resistance heater at a distance between two to four inches away from the first ink printed image on the textile item while the textile item is stationary at the second print processing station;

c) supplying power to the electrical resistance heater to heat the ink of the underprinted base layer of ink on the textile item for curing;

d) sensing the temperature of the ink of the underprinted base layer of ink on the textile item with an infrared sensor as the heater heats the ink and generating an ink temperature signal in response thereto;

c) comparing the value of the ink temperature signal to a preselected maximum temperature value and interrupting power to the heater when the value of the ink temperature signal exceeds the preselected maximum temperature value, whereby the preselected maximum temperature value for the underprinted base layer of ink on the textile item is sufficient to cure the underprinted base layer of ink and facilitate effective printing of subsequent images on the underprinted base layer of ink without allowing heat from the electrical resistance heater to damage the underprinted base layer of ink or damage the underlying textile;

f) moving the textile item to a third print processing station and screen printing a second image on the textile item which covers the heat-cured underprinted base layer of ink at least in part while the textile item is located at the third print processing station; and g) repeating steps a–e for each of the textile items.

4. A method as recited in claim 3 further comprising the steps of:

providing a heat retaining board;

mounting the electric resistance heater to the heat retaining support board; and blowing cooling air through an inlet location into an enclosed space directly above the heat retaining support board to which the electric resistance heaters are mounted, and allowing the cooling air to exit the enclosed space at an exit location which is across the space from the inlet location.

5. In an automatically indexing silk screen printing machine having a series of pallets that are sequentially moved among a plurality of print processing stations including a plurality of silk screen printing stations and at least one heat curing station, an improved heat curing station comprising:

a frame;

a flash unit housing having a top hood and an open bottom, the housing being mounted to the frame;

a heat retaining heater support board mounted inside of the housing and spanning completely across the housing;

a bank of electric resistance heaters mounted to the support board so that the heaters are exposed through the bottom of the housing;

a control box for the heat curing station mounted to the hood of the housing; and a fan for blowing cooling air in a space between the heater support board and the top hood of the housing in a direction substantially parallel to the heater support board.

6. A heat curing station as recited in claim 5 wherein the fan blows cooling air in the space between the heater support board and the hood of the housing towards one end of the housing, and the hood has three cooling air outlets spaced across the other end of the hood.

7. A heat curing station as recited in claim 5 further comprising a hinge that mounts the hood to the housing, wherein the hinge is located towards the center of the silk screen press.

8. In an automatically indexing silk screen printing machine having a series of pallets that are sequentially moved among a plurality of print processing stations including a plurality of silk screen printing stations and at least one heat curing station, an improved heat curing station comprising:

a frame;

a bank of electrical resistance heaters for heat curing an underprinted layer of ink printed on a fabric at one of the silk screen printing stations of the automatically indexing silk screen printing machine; and a control system for regulating the operation of the electrical resistance heaters, the control system having an infrared sensor that senses the temperature of the ink printed on the fabric and outputs an ink temperature signal in response thereto, a temperature controller that receives the ink temperature signal from the infrared sensor and interrupts power to the bank of electric resistance heaters if the value of the ink temperature signal exceeds a preselected maximum temperature value set in the controller;

whereby the preselected maximum temperature value set in the controller for the underprinted layer of ink on the fabric is sufficient to cure the underprinted layer of ink and facilitate effective printing of subsequent images on the underprinted layer of ink at another silk screen printing station on the automatically indexing silk screen printing machine without allowing heat from the heat curing station to damage the underprinted layer of ink or damage the fabric.

9. A heat curing station as recited in claim 8 wherein the control system further comprises a proximity switch that detects when a pallet is located at the heat curing station, wherein electric power cannot automatically be provided to the electric resistance heaters when a pallet is not located at the heat curing station.

10. A heat curing station as recited in claim 9 further comprising an override switch that allows power to be supplied to the electric resistance heaters even when the proximity switch does not sense the presence of a pallet in the heat curing station.

11. A heat curing station as recited in claim 9 wherein the control system also includes a timer, and wherein the control system interrupts power to the electric resistance heater if the electric resistance heater has received electrical power for a period of time greater than or equal to a preset maximum time period.

12. A heat curing station as recited in claim 11 wherein the control system further comprises a normally closed, time-delayed relay switch in parallel with a temperature control switch to allow electric power to be supplied to the electric resistance heaters after the proximity switch senses the presence of a pallet in the heat curing station, and before the temperature control switch can be reset.

13. A heat curing station as recited in claim 8 further comprising:

a housing for the electric resistance heater;

a control box mounted to the housing, the control box containing the control system; and a fan that blows cooling air into the control box to create a positive pressure therein, wherein the infrared sensor senses the temperature of the ink printed on the fabric, and is located within the control box in an at least partially sheltered passage passing from the control box through the housing, and there is at least one air passage in close proximity to a lens of the infrared sensor passing from the control box into the housing which provides an air flow in front of the lens to shelter the lens from contaminants.

14. In a multi-colored silk screen printing press having a series of pallets that are moved among a sequence of print processing stations including a plurality of silk screen printing stations and at least one heat curing station, an improved heat curing station comprising:

a bank of quartz flash lamps for heat curing ink printed on a printing substrate mounted on a pallet of the screen printing machine;

means for supplying electric power to the bank of quartz flash lamps when a pallet is located in the heat curing station, said means comprising a proximity switch that detects when a pallet is located at the heat curing station and wherein electric power cannot automatically be provided to the bank of quartz flash lamps when a pallet is not located at the heat curing station;

means for interrupting electrical power to the bank of quartz flash lamps when the temperature of the ink on the substrate at the heat curing station exceeds a preselected maximum temperature means for interrupting electrical power to the bank of quartz flash lamps when the period of time that power has been supplied to the bank of quartz flash lamps exceeds a preselected maximum time period; and time-delayed means comprising a time-delayed relay switch in parallel with a temperature control switch to allow electric power to be supplied to the quartz flash lamps after the proximity switch senses the presence of a pallet in the heat curing station and before the temperature control switch is reset.

* * * * *